US005125132A

United States Patent [19]

Weber

[11] Patent Number: 5,125,132

[45] Date of Patent: Jun. 30, 1992

[54] CARD FEEDER HAVING A FEED TABLE PROVIDED WITH A CARDING ELEMENT

[75] Inventor: Wilfried Weber, Mönchengladbach, Fed. Rep. of Germany

[73] Assignee: Trützschler GmbH & Co. KG, Mönchengladbach, Fed. Rep. of Germany

[21] Appl. No.: 576,651

[22] Filed: Sep. 4, 1990

[30] Foreign Application Priority Data

Sep. 4, 1989 [DE] Fed. Rep. of Germany ..... 3929341

[51] Int. Cl.[5] ..... D01G 15/20; D01G 15/84; D01G 15/40

[52] U.S. Cl. ..... 19/105; 19/114

[58] Field of Search ..... 19/105, 65 R, 89, 96, 19/97.5, 98, 105, 107, 108, 204, 205, 145.7, 102, 104, 110, 114,

[56] References Cited

U.S. PATENT DOCUMENTS

| | | | |
|---|---|---|---|
| 2,403,384 | 7/1946 | Locke | 19/105 |
| 3,151,362 | 10/1964 | Freitag | 19/114 |
| 4,100,650 | 7/1978 | Wirth et al. | 19/105 |
| 4,539,728 | 9/1985 | Portell | 19/105 |
| 4,817,247 | 4/1989 | Leifeld et al. | 19/105 |

FOREIGN PATENT DOCUMENTS

| | | | |
|---|---|---|---|
| 0268501 | 5/1968 | Austria | 19/105 |
| 1938539 | 12/1972 | Fed. Rep. of Germany . | |
| 3336825 | 7/1984 | Fed. Rep. of Germany . | |
| 0308114 | 7/1971 | U.S.S.R. | 19/105 |
| 1004496 | 3/1983 | U.S.S.R. | 19/105 |
| 0016009 | of 1889 | United Kingdom | 19/105 |
| 0754548 | 8/1956 | United Kingdom | 19/105 |
| 0791339 | 2/1958 | United Kingdom . | |
| 0832803 | 4/1960 | United Kingdom | 19/105 |
| 0919531 | 2/1963 | United Kingdom . | |
| 0930065 | 7/1963 | United Kingdom . | |
| 0960637 | 6/1964 | United Kingdom | 19/105 |
| 0967801 | 8/1964 | United Kingdom | 19/114 |
| 0005740 | 12/1983 | United Kingdom | 19/105 |

*Primary Examiner*—Werner H. Schroeder
*Assistant Examiner*—Ismael Izaguirre
*Attorney, Agent, or Firm*—Spencer, Frank & Schneider

[57] ABSTRACT

A carding machine includes a feed roll, a feed table cooperating with the feed roll and defining a nip therewith; and a licker-in arranged for plucking exiting fiber material from the nip. The feed table has an end face which is oriented toward the licker-in and which carries a carding element having carding points projecting toward the licker-in. The carding points are formed by surface roughening or by the provision of a granular coating.

2 Claims, 2 Drawing Sheets

CM
1
2
3
4
5
6
7
8
9
10
11
12
13
14
15
16
17
18

CARD FEEDER HAVING A FEED TABLE PROVIDED WITH A CARDING ELEMENT

CROSS REFERENCE TO RELATED APPLICATION

This application claims the priority of Federal Republic of Germany Application No. P 39 29 341.6 filed Sep. 4, 1989, which is incorporated herein by reference.

BACKGROUND OF THE INVENTION

1. Field of the Invention

This invention relates to a card feeder which includes a feeding assembly formed of a feed roll and a feed table cooperating therewith for advancing the fiber material to a rapidly rotating clothed licker-in of a card, plucking the material emerging from the nip defined between the feed roll and the feed table.

2. Description of the Related Art

In a known device of, the above-outlined type, as the fiber beard is torn from the nip defined between the feed roll and the feed table, the fiber material is deflected. During such a handling, the fiber material is, as viewed along its width, irregularly (non-uniformly) roughened which may result in non-uniform densities in the fiber web discharged by the carding machine.

SUMMARY OF THE INVENTION

It is an object of the invention to provide an improved device of the above-outlined type which ensures that the fiber web has an improved uniformity in density.

This object and others to become apparent as the specification progresses, are accomplished by the invention, according to which, briefly stated, that end face of the feed table which is oriented towards the licker-in is provided with at least one carding element having carding points projecting towards the licker-in.

By virtue of the carding points, the fiber material, immediately after being torn from the nip defined by the feed roll and the feed table, undergoes a combing effect before it reaches a waste separating device such as a mote knife. In this manner, a certain parallelization of the fibers and a thickness evening of the fiber layer are achieved. Fibers that project away from the fiber mass are forced back into the fiber layer.

Expediently, the carding points project slightly beyond the base body of the carding element. In this manner there is achieved a deflection or alignment of the fibers. Preferably, the carding points project approximately 0.1 to 1 mm beyond the base body; by this feature a significant deformation (flattening) of the carding teeth is avoided.

The invention has the following additional advantageous features:

The carding points project from a smooth surface;

The base body from which the carding teeth project is strip-like; for example, it is formed of metal strips;

The base body and the carding points form a one-piece unit;

The carding points are made by means of a local pressure, for example, by a spiked roll, on the rear surface of the strip-shaped base body;

The carding element is situated in a recess from which the carding points project to a predetermined distance;

The carding points are formed of a granular material with which the base body is coated;

The carding points are formed of short wires which project from the base body;

The end face of the feed table, oriented towards the licker-in is roughened;

The end face of the feed table oriented towards the licker-in is itself provided with carding points;

The carding points are made by embossing the surface of the base body;

The feed roll and the licker-in rotate codirectionally;

The clothing points on the feed roll are inclined in a direction which is opposite the direction of rotation while the clothing points on the licker-in are oriented in the direction of rotation.

DESCRIPTION OF THE PREFERRED EMBODIMENT

Figure 1:
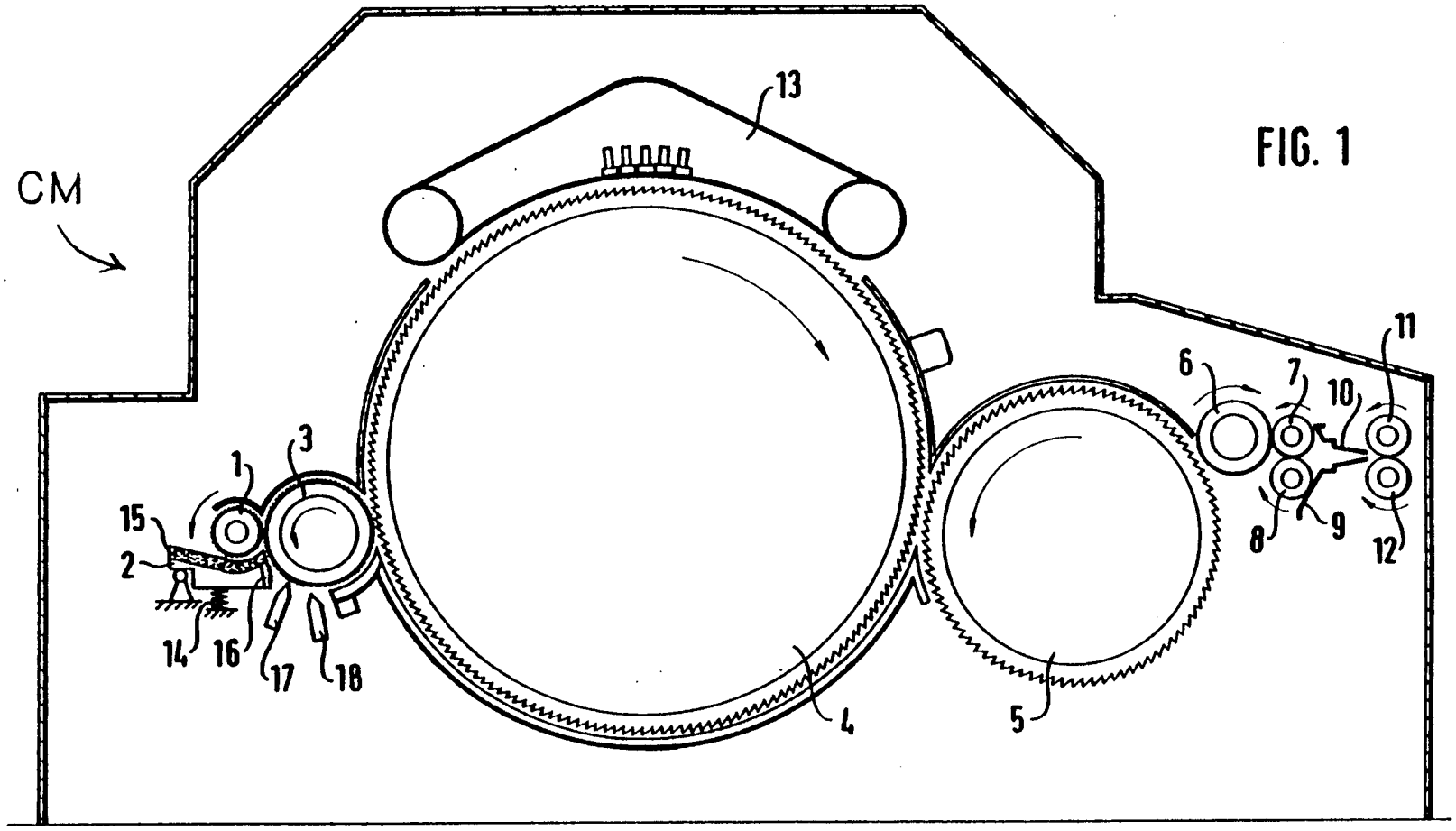
FIG. 1 is a schematic side elevational view of a carding machine incorporating the invention.

Turning to FIG. 1, there is illustrated therein a known carding machine CM which may be an EXACTACARD DK 740 model, manufactured by Trtzschler GmbH Co. KG, Mönchengladbach, Federal Republic of Germany. The carding machine CM has a feed roll 1, a feed table 2 cooperating therewith, a licker-in 3, a main carding cylinder 4, a doffer 5, a stripping roll 6, crushing rolls 7, 8, a web guiding element 9, a sliver trumpet 10, calender rolls 11, 12 and travelling flats 13. The feed table 2 is movably and resiliently supported by a spring 14. The feeding device 1, 2 advances a fiber batt 15.

Figure 2:
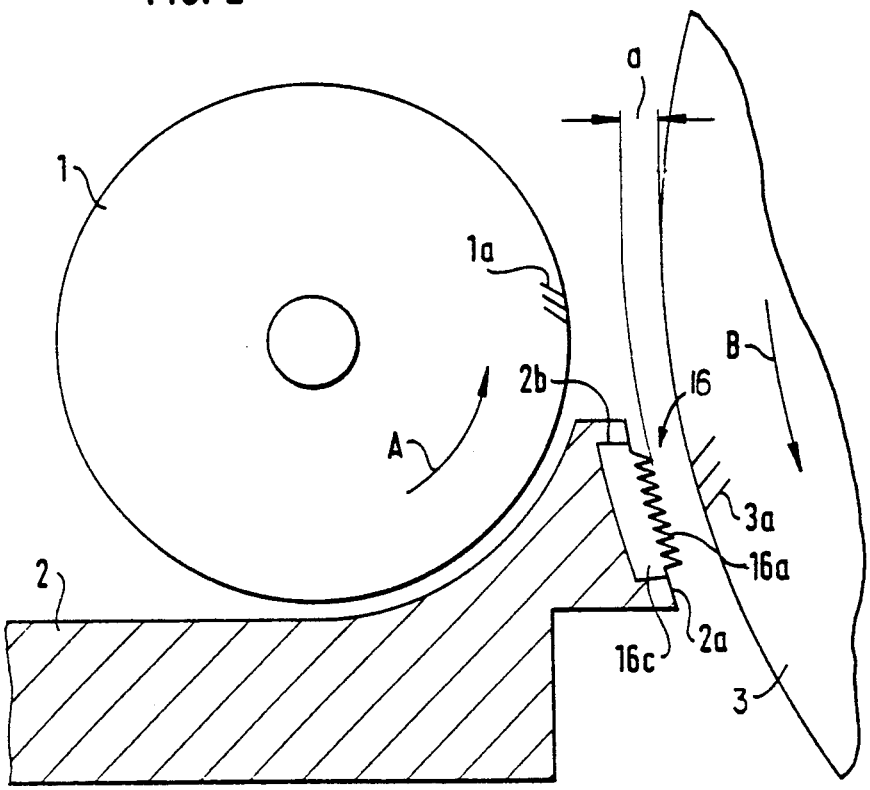
FIG. 2 is a partially sectional schematic side elevational view of a preferred embodiment of the invention.

Also referring to FIG. 2, on the end face 2*a* of the feed table 2, oriented towards the licker-in 3 a carding element 16 is arranged. The feed roll 1 rotates slowly, for example, with a speed of 0.5–6 rpm, while the licker-in has a speed of approximately 600–900 rpm. The licker-in 3 is associated with two mote knives 17, 18 for separating waste from the fiber material.

Figure 3:
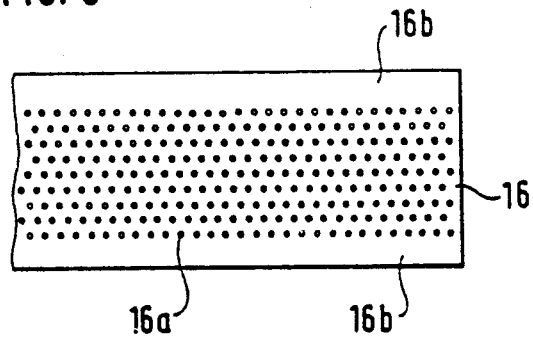
FIG. 3 is a fragmentary end elevational view of a component of the preferred embodiment.

The carding element 16 extends along the entire width of the feed table 2. Also referring to FIG. 3, the carding element 16 has a base body 16*c* provided with a surface 16*b*, from which carding points 16*a* which project towards the licker-in 3. The distance a between the carding points 16*a* and the points of the clothing 3*a* of the licker-in 3 is between approximately 0.13–0.25 mm. The rotary directions of the feed roll 1 and the licker-in 3 are identical and are designated with arrows A, B, respectively. The clothing points 1*a* of the feed roll 1 are oriented opposite the direction of rotation A of the feed roll 1 whereas the clothing points 3*a* of the licker-in 3 are oriented towards the rotary direction B. The carding element 16 is received in a recess 2*b* provided in the end face 2*a* of the feed table 2 and conforming to the outline of the body of the carding element 16.

Figure 4:
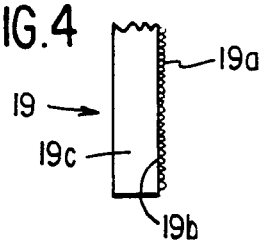
FIG. 4 is a schematic fragmentary side elevational view of a component of another preferred embodiment.

In the embodiment illustrated in FIG. 4 a carding element 19 is shown, wherein the carding points are formed of a granular material 19*a* applied to a surface 19*b* of a base body 19*c*.

Figure 5:
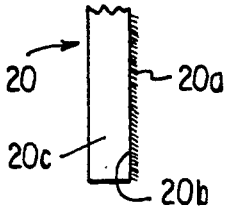
FIG. 5 is a schematic fragmentary side elevational view of a component of a further preferred embodiment.

FIG. 5 shows an embodiment where a carding element 20 has carding points formed of short wires 20*a* projecting from a surface 20*b* of a base body 20*c*.

Figure 6:
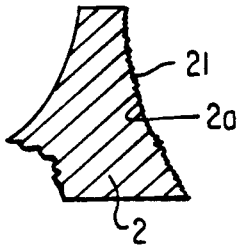
FIG. 6 is a schematic fragmentary sectional side elevational view of a component of yet another preferred embodiment.

In FIG. 6 the end of the feed table 2 is illustrated, wherein the carding points are formed by a roughened surface 21 of the end face 2*a* of the feed table 2.

The carding elements 19, or 20 or 21 may be installed on the end face 2*a* of the feed table 20 similarly to the carding element 16 shown in FIG. 2.

It will be understood that the above description of the present invention is susceptible to various modifications, changes and adaptations, and the same are intended to be comprehended within the meaning and range of equivalents of the appended claims.

What is claimed is:

1. In a carding machine including a feed roll, a feed table cooperating with said feed roll and defining a nip therewith; and a licker-in arranged for plucking exiting fiber material from said nip; the feed table having an end face oriented toward said licker-in; said licker-in having a clothing; the improvement comprising a carding element carried on said end face and having carding points projecting toward the licker-in; said carding element comprising a base body and a granular coating provided on the base body; said carding points being formed of said granular coating.

2. In a carding machine including a feed roll, a feed table cooperating with said feed roll and defining a nip therewith; and a licker-in arranged for plucking exiting fiber material from aid nip; the feed table having an end face oriented toward said licker-in; said licker-in having a clothing; the improvement comprising a carding element carried on said end face and having carding points projecting toward the licker-in; said carding points being formed of a roughened area of said end face.

* * * * *